US005459074A

United States Patent [19]

Muoni

[11] Patent Number: 5,459,074

[45] Date of Patent: Oct. 17, 1995

[54] MATERIALS AND METHODS FOR REDUCING LUBRICANT OIL BREAKDOWN

[75] Inventor: Rein Muoni, Tartu, Estonia

[73] Assignee: Helsinki University Licensing, Ltd., Helsinki, Finland

[21] Appl. No.: 276,946

[22] Filed: Jul. 19, 1994

[51] Int. Cl.[6] ..... G01N 33/30

[52] U.S. Cl. ..... 436/60; 422/190; 422/193; 422/195; 422/197; 422/238; 422/239; 422/261

[58] Field of Search ..... 422/190, 193, 422/195, 197, 238, 239, 261; 436/60; 210/767

[56] References Cited

U.S. PATENT DOCUMENTS 5,275,747 1/1994 Gutierrez et al. ..... 252/51.005

*Primary Examiner*—Robert J. Warden

*Assistant Examiner*—N. Bhat

*Attorney, Agent, or Firm*—Marshall, O'Toole, Gerstein, Murray & Borun

[57] ABSTRACT

Provided are materials and methods for increasing the working life of a lubricant oil in an engine, including alkaline compositions which are added to said oil, and an apparatus containing the alkaline compositions to be placed in said engine through which oil passes.

23 Claims, 3 Drawing Sheets

MATERIALS AND METHODS FOR REDUCING LUBRICANT OIL BREAKDOWN

FIELD OF THE INVENTION

The present invention generally relates to materials and methods for decreasing lubricant oil breakdown, thereby prolonging the period between necessary oil changes. Materials and methods of the invention also prolong engine life by reducing wear normally due to friction and heat.

BACKGROUND OF THE INVENTION

Continued use of a proper lubricating oil is essential for the maintenance of any internal combustion engine. The use of an appropriate lubricating system not only enhances engine performance, but prolongs the effective life of the engine. Standard lubricating systems for internal combustion engines generally comprise a petroleum-based oil. Such an oil functions in the engine to facilitate the movement of engine parts, to minimize wear due to friction, to remove heat from the engine parts, to absorb shocks between engine parts, to form a seal between piston rings and piston cylinder walls, and to cleanse the engine.

Due to the range of performance that is demanded from it, a satisfactory lubricating oil must have several properties. Primary among these is a favorable viscosity rating. Viscosity is a measure of the resistance of a liquid to flow. The viscosity of an oil determines the ease with which engine parts move with respect to each other. Viscosity may be influenced by temperature, pressure, and shear forces due to fluid movement. For example, as temperatures increase, lubricant oil viscosity tends to breakdown, resulting in increased fluidity. The viscosity index is an empirical system for expressing the change in viscosity with changing temperatures on a scale from 0 to 100. However, oils with a viscosity index of greater than 100 may be manufactured from crude oils by the addition of, for example, polymers to the oil.

During prolonged exposure to high temperatures in an engine (and to fluctuations between high and low temperatures) a reduction in viscosity may occur. Thus, at temperatures at which an engine operates, the oil may become more fluid in character, making the oil more susceptible to penetration during the application of heavy loads. For example, during the application of a load, an oil with the proper viscosity will form a film around bearings to allow movement and to create a seal, for example, between piston rings and cylinder walls, and will help absorb shock. Upon a reduction in viscosity, the oil will form a less-adequate seal and will not maintain the necessary film on bearings and the like, resulting in wear on engine parts due to friction.

Another important property of lubricant oils is a resistance to carbon formation. At the high temperatures which result from operation of most engines, oil may be burned to produce carbon. Formation of carbon on engine components results in poor engine performance by, for example, causing piston rings to stick to ring grooves in the cylinder housing the piston. Obviously, carbon formation also results in inefficient utilization of the oil.

A good lubricating oil should also be resistant to oxidation. At high temperatures, oils become oxidized and the products of oxidation may coat engine parts, retarding movement. However, perhaps the greatest contributor to the loss of effectiveness of lubricant oil is the formation and accumulation of contaminants. Acids, as well as carbon, produced by the breakdown of engine oil may form in the combustion chamber, resulting in inefficient engine operation.

Largely as a result of the accumulation of contaminants, viscosity breaks down, both in terms of flow and resistance to penetration. That, among other factors, causes wear on engine parts which, in turn, requires more oil consumption for proper function. Accordingly, engine oil must be changed on a regular basis in order to prevent permanent damage to engine components. Most commercially-available engine oils contain additives (e.g., detergents) which reduce the accumulation of contaminants. However, such additives do not prevent the breakdown in viscosity and accumulation of acidic waste products and carbon which result from prolonged use of engine oil. Typically, automobile manufacturers recommend that oil be changed after 3000 miles of operation, which amounts to about 100–250 hours of engine operation. Replacement intervals for other types of engines vary depending upon the type of engine and the use to which the engine is put.

As shown by the foregoing, there is a need in the art for materials and methods for prolonging the working life of a lubricating oil in an engine and for preventing lubricant oil breakdown as provided in the present invention, a summary of which follows.

SUMMARY OF THE INVENTION

The present invention generally relates to materials and methods for increasing the working life of a lubricant oil in an engine. Materials and methods of the invention retard viscosity breakdown and the formation of harmful engine contaminants which are common as a result of prolonged use of lubricant oils of the art. Materials and methods of the invention are useful in any engine requiring lubricant oil. For purposes of the present invention, working life is equivalent to service life and is expressed in terms of the number of hours an oil may be effectively used in an engine. (See Example 1 below.)

In a preferred embodiment of the invention, methods are provided for prolonging the working life of a lubricant oil in an engine, comprising repeatedly exposing said lubricant oil to an alkaline composition. Also in a preferred embodiment of the invention, methods are presented for prolonging the working life of a lubricant oil in an engine comprising repeatedly exposing a lubricant oil in an engine to a first composition comprising $SnO_2$, NaOH, and aluminum, and to a second composition, comprising, iodine in alcohol. The order in which the oil encounters the first and second compositions may be reversed. However, methods according to the invention produce optimal results when the lubricant oil is exposed to a first composition comprising $SnO_2$, NaOH, and aluminum followed by exposure to a second composition comprising iodine in alcohol (e.g., ethanol). According to the invention, $SnO_2$ and NaOH may be present in said composition in a ratio of 1:3 and said iodine may be present as a 5% (by weight) solution in alcohol. Preferably, the $SnO_2$ and NaOH used in the invention are heated to approximately 100° C. in order to form a solid (pellets or sheets) which is then combined in a 1:1 ratio with aluminum.

In a preferred embodiment of the invention, said lubricant oil is passed through at least one self-contained chamber containing said first composition and is additionally passed through another self-contained chamber containing an absorbtive substance, such as cloth or a similar material, impregnated with iodine in alcohol. The cloth substance may be any substance capable of absorbing a liquid, such as linen, cotton, and the like. According to methods of the invention, lubricant oil in an engine passes through chambers comprising the aforementioned substances. Upon consideration of the present invention, the skilled artisan recognizes that numerous other alkaline substances may be used in methods according to the invention.

The present invention also provides an apparatus for delivering compositions according to the invention to a lubricant oil in an engine and thereby prolonging the working life of the lubricant oil in said engine. In a preferred embodiment, an apparatus according to the invention comprises a housing having connected to it at least one conduit for flow of said lubricant oil into said housing and at least one conduit for flow of said lubricant oil out of said housing; and at least one chamber capable of containing an alkaline composition through which said lubricant oil in said engine may pass. In a highly-preferred embodiment, an apparatus according to the invention comprises at least two chambers wherein a first chamber comprises a means for receiving lubricant oil and contains a composition comprising $SnO_2$, NaOH, and aluminum; and a second chamber in liquid communication with said first chamber which contains an absorptive substance, such as cloth or a similar material which has been impregnated with an iodine solution in alcohol. Also in a preferred embodiment, an apparatus according to the invention comprises a first chamber having means for receiving lubricant oil; an absorptive material contained within said first chamber which absorptive material is impregnated with a first composition comprising iodine in alcohol; a second chamber in liquid communication with the first chamber and containing a solution comprising $SnO_2$, NaOH, and Al; a conduit for flow of lubricant oil into the apparatus; and a conduit for flow of lubricant oil out of the apparatus. Preferably, the combined $SnO_2$, NaOH, and aluminum are layered in the appropriate chamber of an appratus according to the invention, such that oil passing through the chamber passes through the particulate reagent.

In a preferred embodiment of the invention, a filter doser comprises a housing which surrounds capped chambers, said capped chambers comprising a first chamber which contains a composition comprising $SnO_2$, NaOH, and aluminum and a second chamber in which a cloth substance impregnated with an iodine/alcohol solution exists. Compositions for use in the invention may be interspersed with aluminum fragments, preferably about 3–6 mm in diameter. The walls of the chambers of an apparatus according to the invention have apertures through which oil may pass between and through the chambers.

A filter doser according to the invention may optionally comprise a safety valve designed to relieve excessive pressure in the filter doser. The safety valve may be set on a thin elastic rectangular plate that is upheld by a capping lid attached, for example by a screw means, to a small cylinder wall and covered by a lid of the filter doser. The safety valve contains a spring.

Compositions according to the present invention may be added to engine oil by any means known to those skilled in the art. Mixture of the compositions disclosed herein with engine oil prolongs the life of the engine oil regardless of the means by which oil is exposed to said compositions. However, a presently-preferred means for delivering compositions according to the invention is a filter doser as described and claimed herein.

A detailed description of the invention follows.

DETAILED DESCRIPTION OF THE INVENTION

Figure 1:
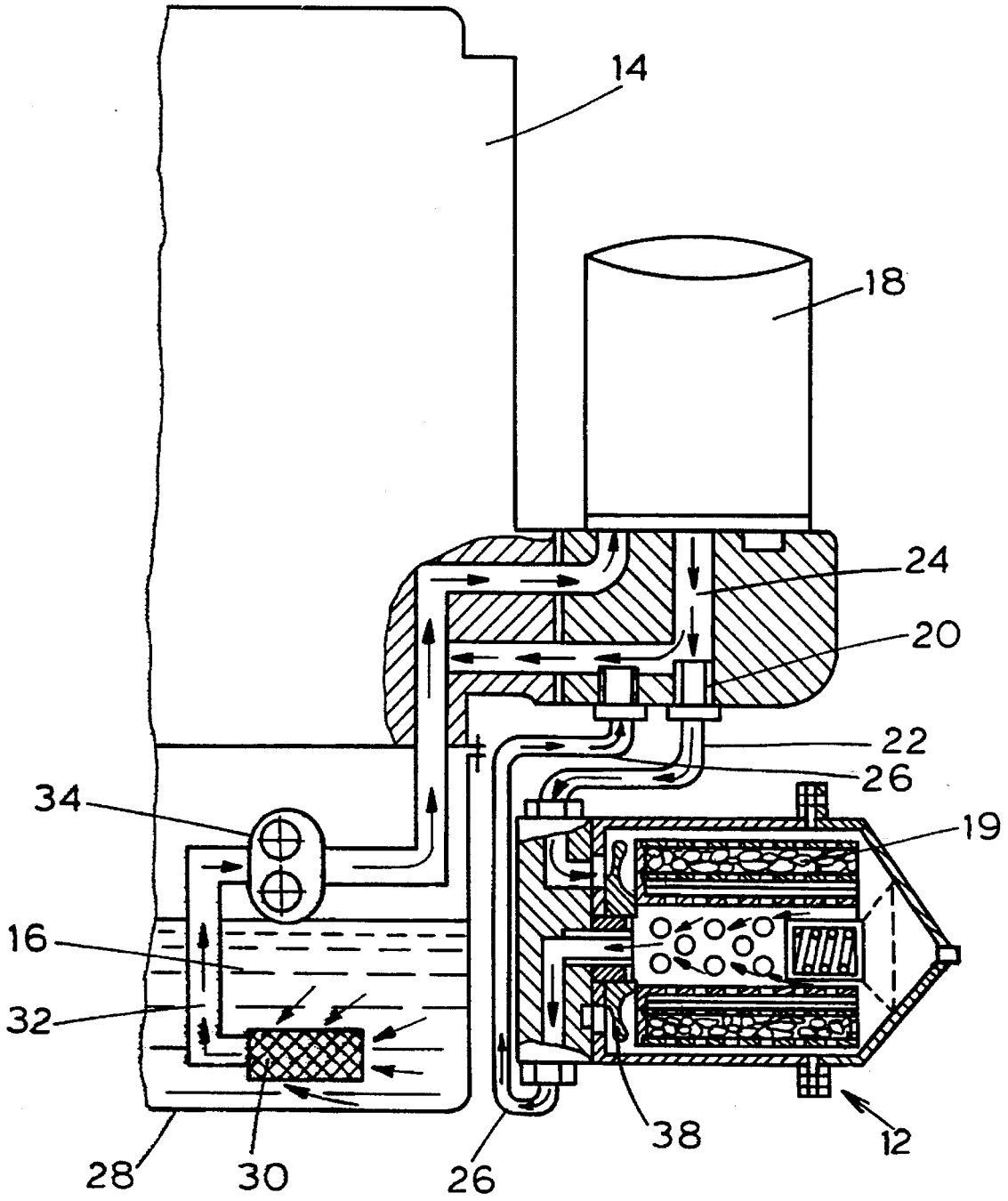
FIG. 1 is a schematic partial cross-section of an apparatus according to the invention in the context of a diesel engine.

FIG. 1 illustrates a filter doser 12 in accordance with the present invention which is connected to an engine 14 (such as a Valmet 420 DS diesel engine) and is disposed in contact with a conventional oil filter 18 and in contact with the engine 14. As shown in FIG. 1, oil 16, having passed through an oil filter 18, passes through the filter doser 12 where compositions 19 in the filter doser 12 are added to the oil 16. A threaded fitting 20 is incorporated under the oil filter 18 and operates such that approximately half the oil 16 passes from the oil filter 18 to the engine 14 and approximately half the oil 16 passes from the oil filter 18 to the filter doser 12. Oil 16 passes from an oil pan 28, through a rough filter 30, and into a main engine oil passage 32. An oil pump 34 is disposed in the main engine oil passage 32 and pressurizes oil 16 such that oil 16 flows through the oil filter 18 and through the engine 14 in a conventional manner. Oil 16 exits the oil filter 18 through a reflux conduit 24 into the first oil conduit 22 leading to the filter doser 12. Having passed through the filter doser 12, said oil 16 exits the filter doser 12 through a second oil conduit 26 connected to the engine 14.

Figure 2:
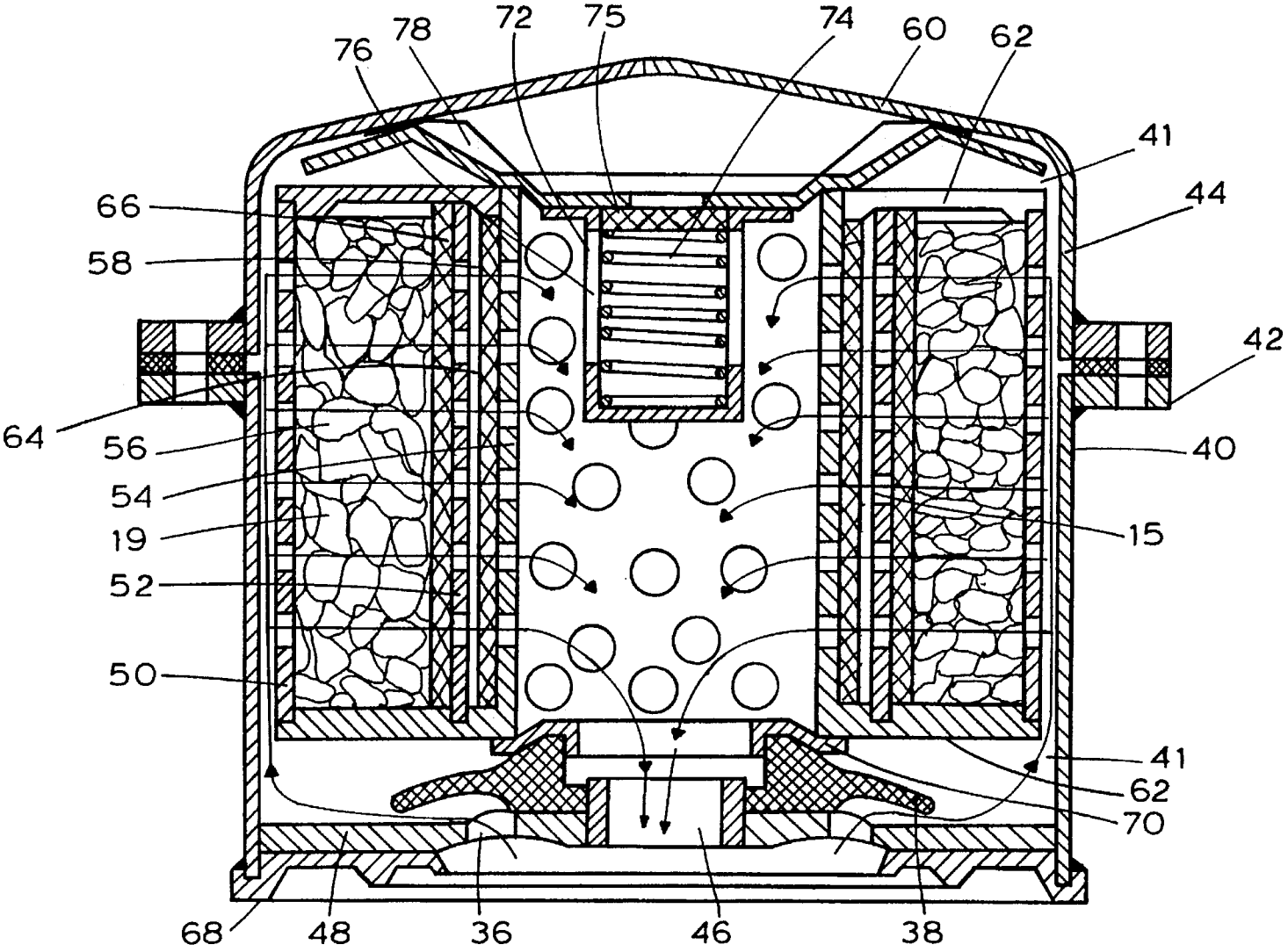
FIG. 2 is a cross section of an apparatus of the invention.

As shown in FIG. 2, the filter doser 12 comprises an outer casing 40, one or more flanges 42 to support a lid 44 which is attached to the outer casing 40 with an attachment means, such as screw bolts (not shown). Inflow ports 36 and outflow ports 46 are preferably placed in a floor 48 of the filter doser 12 to facilitate flow of oil 16 through the filter doser 12. Being under pressure, oil 16 passes from the oil filter 18 to the filter doser 12 through inflow ports 36.

The oil 16 passes through a shutter valve 38 into an outer compartment 41. The oil 16 next passes through large, medium, and small cylindrical walls (50, 52 and 54, respectively) each having apertures 15, each of which is approximately 3 mm in diameter. A large outer cylindrical wall 50 and a medium inner cylindrical wall 52 define a first annular chamber 56. Similarly, the medium inner cylindrical wall 52 and a small central cylindrical wall 54 define a second annular chamber 58. The chambers 56, 58 are capped at their ends by first and second capping lids 60 and 62. The second annular chamber 58 contains an absorptive material 64 (cloth or similar substance, such as linen, cotton, and the like) impregnated with 5% iodine solution in alcohol. The first annular chamber 56 contains an alkaline composition 19, comprising $SnO_2$, NaOH, and Al, which may be present as pieces of approximately 3–6 mm. The outer surface of the medium cylindrical wall 52 optionally comprises a meshwork filter 66 or, if no meshwork filter, said medium cylindrical wall has apertures of approximately 2.5 mm. Oil is pressed through the large cylindrical wall 50 to the first annular chamber 56 and through the meshwork filter 66 and the medium cylindrical wall 52 to the second annular chamber 58 and then through the small cylindrical wall 54 to the outflow port 46 having passed, in the process, through the chemical composition 19.

A bottom cap 68 and a gasket 70 prevent leakage of oil out of the filter doser 12. The filter doser 12 may also comprise a safety valve 72, comprising a spring 74 and disc 75 in a casing 76 which may preferably be partially open. The safety valve 72 is mounted on a plate 78. If the pressure of the oil 16 in the outer compartment 41 exceeds a predetermined level, the pressure acting on the disc 75 overcomes the force applied by the spring 74, thereby opening the safety valve 72 by lowering the disc 75. With the safety valve 72 open, oil 16 may flow directly from the outer compartment 41 to the outflow port 46, without flowing through chambers 56 and 58. The safety valve 72 thus prevents an excessive rise in oil pressure, for example, due to a blockage in either of chambers 56 or 58.

EXAMPLE 1

COMPARATIVE OPERATION OF ENGINES WITH AND WITHOUT A FILTER DOSER

A comparison was made to determine the working life of engine oil in an engine having a filter doser according to the invention, wherein compositions according to the invention are introduced into the engine's oil versus the working life of oil in an engine in which compositions were not introduced into the oil. Working life, as defined herein, is the time an oil functions in an engine as a lubricant without significant breakdown of viscosity and/or accumulation of contaminants.

Figure 3:
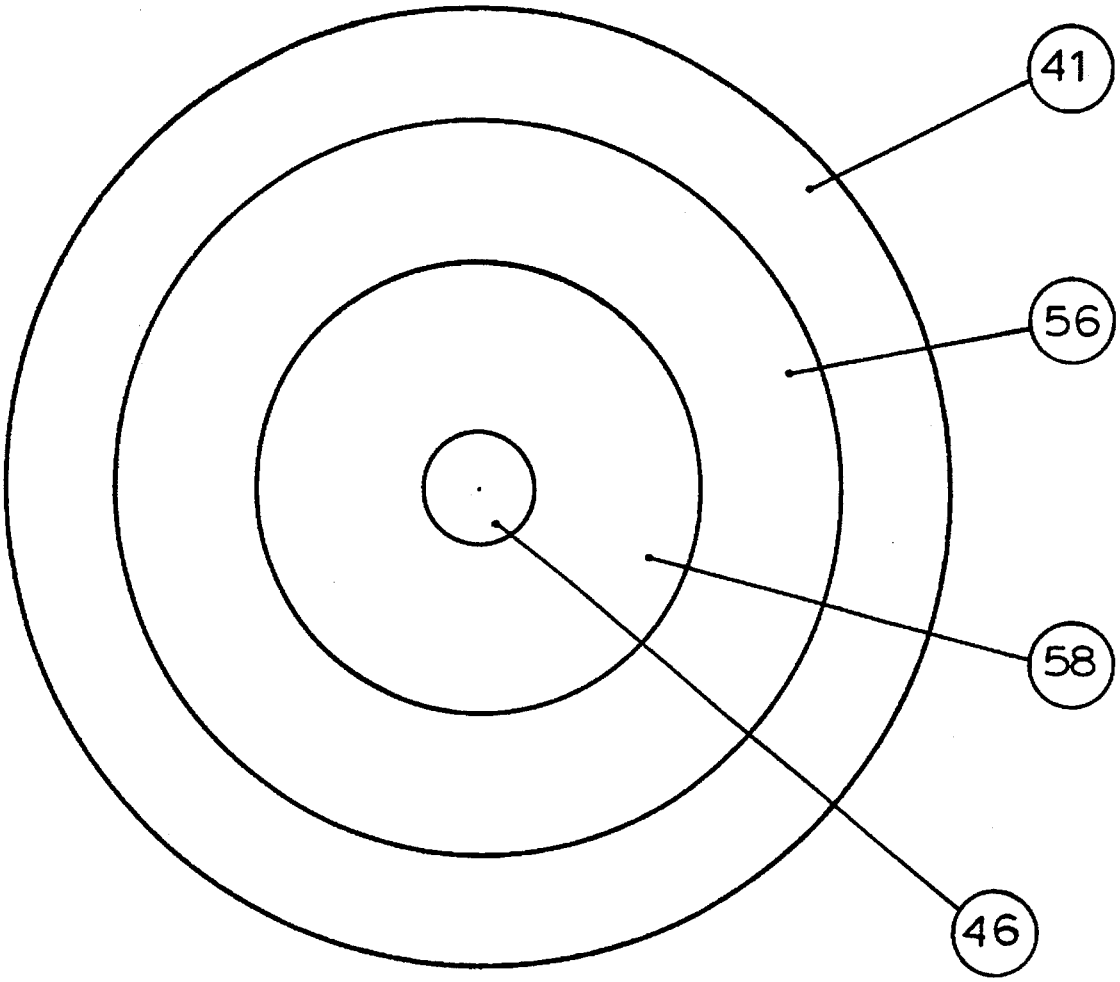
FIG. 3 is a schematic top view of a filter doser of the invention showing the relationship between chambers.

For the purpose of demonstrating the operation of a filter doser according to the invention, a Valmet 420 DS diesel engine was used. Accordingly, a filter doser was manufactured to operate in that environment. It is, however, apparent to the skilled artisan that methods and apparatus according to the invention will be effective in any engine requiring lubricant oil. Moreover, the skilled artisan knows how to design an apparatus according to the invention for use in smaller or larger engines. Thus, for exemplification of the invention the dimensions of the specific filter doser used are provided by reference to FIG. 3. The filter doser used had a volume of approximately 0.5 1 and a total diameter of approximately 12 cm. The outer compartment 41 was 1 cm in width (radial distance); the first chamber 56 had a width (radial distance) of approximately 4 cm and a diameter of approximately 10 cm. The first chamber 56 contained 350 g of a composition comprising $SnO_2$ and NaOH in a 1:3 ratio by weight. The $SnO_2$ and NaOH were heated to about 100° C. to form pellets. The pellets were then combined with particulate aluminum in a 1:1 ratio by weight and the total particulate matter (i.e., $SnO_2$, NaOH and aluminum) was layered in approximately 30 thin layers around the interior of the first chamber 56. The second chamber 58 was approximately 1.7 cm in width (radial distance) and approximately 6 cm in diameter, and contained a cloth impregnated with 5% iodine in alcohol (e.g. ethanol), the iodine solution being made from 5 g molecular iodine. Finally, the filter doser used in the following example contained an outflow port 26 of approximately 5 cm in diameter.

Tractor engines (Valmet 420 DS diesel) were used in a comparison of the stability of engine oil over time. The engines were identical except that one had a filter doser of the invention installed as described above and in FIG. 1. The engines were run continuously from time=0 to time=400 h or time=750 h as indicated below. Load was placed on the engines such that the engines worked at 30% of their capacity for the first 50 hours, 75% of their capacity for the next 100 hours, and 100% of their capacity for the next 100 hours. Load was then reduced to 30% of capacity for 50 hours; then 75% of capacity for 50 hours; and 100% of capacity for 50 hours. The engine in which composition according to the invention was introduced ran an additional 350 hours; wherein load was 30% for the next 100 hours (after expiration of the initial 400 hours), followed by 75% of capacity for 125 hours, and 100% capacity for the last 125 hours. The results with respect to several critical parameters of oil quality are presented below in Tables 1 and 2. Table 1 shows data obtained from an engine in which compositions according to the invention were not introduced into the engine's oil. Table 2 shows data obtained from an engine in which compositions according to the invention were introduced into the engine oil by a filter doser according to the invention.

TABLE 1

| | Oil (SAE 10W/30) characteristics without a Filter Doser | | | | | | | | | |
|---|---|---|---|---|---|---|---|---|---|---|
| | Work | Viscosity mm²/s | | Viscosity | | Alkali count mgKOH | Acid count mgKOH | Flash-point | Quantity of water | Quantity of ash, |
| Reference 1 | Hours 2 | 100° C. 3 | 40° C. 4 | Index 5 | pH 6 | g 7 | g 9 | °C. 9 | $H_2O$ 10 | % 11 |
| Oil SAE 10W30 | — | 12.0 | 80.0 | 145.0 | 9.1 | 3.90 | 0.012 | 215 | 0 | 1.250 |
| | 10 | 11.6 | 80.0 | 145.0 | 8.9 | 3.89 | 0.094 | 215 | 0 | 1.060 |
| | 50 | 11.4 | 79.9 | 146.1 | 8.8 | 3.80 | 0.671 | 215 | 0 | 1.040 |
| | 100 | 11.2 | 80.0 | 146.0 | 9.8 | 3.56 | O.%7 | 215 | 0 | 1.012 |
| | 150 | 11.3 | 82.9 | 146.0 | 9.7 | 3.02 | 1,200 | 215 | 0 | 1.009 |
| | 200 | 11.5 | 84.6 | 146.2 | 8.7 | 2.64 | 1.201 | 215 | 0 | 1.000 |
| | 250 | 11.9 | 85.3 | 146.8 | 8.8 | 1.49 | 1.297 | 215 | 0 | 1.008 |
| | 300 | 12.1 | 86.7 | 147.2 | 8.9 | 1.12 | 1,276 | 215 | 0 | 0.998 |
| | 350 | 13.4 | 89.1 | 147.7 | 8.9 | 0.98 | 3.010 | 214 | 0 | 0.929 |
| | 400 | 13.6 | 91.4 | 147.9 | 9.9 | 0.97 | 3.120 | 213 | 0 | 0.898 |

TABLE 2

Oil (SAE 10W/30) characteristics with a Filter Doser

| Reference 1 | Work Hours 2 | Viscosity $mm^2/s$ 100° C. 3 | Viscosity $mm^2/s$ 40° C. 4 | Viscosity Index 5 | pH 6 | Alkali count mgKOH g 7 | Acid count mgKOH g 8 | Flash-point °C. 9 | Quantity of water $H_2O$ 10 | Quantity of ash, % 11 |
|---|---|---|---|---|---|---|---|---|---|---|
| Oil SAE 10W30 | — | 12.0 | 80.0 | 145.0 | 9.1 | 3.90 | 0.012 | 215 | 0 | 1.250 |
| mixed with $SnO_2$ + | 10 | 11.9 | 80.0 | 145.0 | 9.1 | 4.00 | 0.269 | 215 | 0 | 0.970 |
| NaOH + Al + 5% | 50 | 11.7 | 80.3 | 145.0 | 9.1 | 4.28 | 0.476 | 215 | 0 | 1.002 |
| alcohol and iodine | 100 | 11.6 | 80.0 | 145.0 | 9.1 | 4.57 | 0.984 | 215 | 0 | 1.016 |
| solution | 150 | 11.6 | 80.4 | 145.0 | 9.1 | 4.94 | 1.127 | 215 | 0 | 1.026 |
| | 200 | 11.6 | 80.5 | 145.0 | 9.1 | 5.00 | 1.236 | 215 | 0 | 1.051 |
| | 250 | 11.8 | 80.7 | 145.0 | 9.1 | 5.09 | 1.278 | 215 | 0 | 1.074 |
| | 300 | 11.9 | 80.9 | 145.0 | 9.1 | 5.32 | 1,306 | 215 | 0 | 1.096 |
| | 350 | 12.0 | 81.0 | 145.0 | 9.1 | 5.67 | 1.367 | 215 | 0 | 1.102 |
| | 400 | 12.0 | 81.4 | 145.0 | 9.1 | 5.94 | 1.380 | 215 | 0 | 1.116 |
| | 450 | 12.0 | 83.2 | 145.0 | 9.1 | 6.17 | 1.3% | 215 | 0 | 1.120 |
| | 500 | 12.1 | 94.2 | 145.0 | 9.1 | 6.57 | 1.400 | 215 | 0 | 1.127 |
| | 550 | 12.3 | 85.0 | 145.0 | 9.1 | 6.83 | 1.423 | 215 | 0 | 1.134 |
| | 600 | 12.5 | 95.6 | 145.0 | 9.1 | 7.14 | 1.4% | 215 | 0 | 1.136 |
| | 650 | 12.7 | 86.4 | 145.0 | 9.1 | 7.19 | 1.501 | 215 | 0 | 1.147 |
| | 700 | 12.8 | 87.0 | 145.0 | 9.1 | 7.15 | 1.537 | 215 | 0 | 1.197 |
| | 750 | 12.9 | 87.6 | 146.0 | 9.1 | 7.06 | 1.564 | 216 | 0 | 1.210 |

As shown in the tables, oil in the engine having a filter doser according to the invention which delivered compositions according to the invention to said oil was able to be used for 400 hours without any breakdown in viscosity and without a significant buildup of acid byproducts. By contrast, the engine having no filter closer and thus no means for introducing compositions of the invention to the oil, required replacement of oil after 400 hours of operation. Moreover, engines containing a filter doser according to the invention ran for 350 hours more than an engine without a filter doser and did so without significant viscosity breakdown or accumulation of contaminants. The results indicate that, not only does introduction of compositions according to the invention increase the quality of oil after prolonged use, it allows oil to be used for longer periods of time in the engine. As such, the invention reduces costs associated with replacement of engine oil and has the significant benefit of causing less wear on engine parts by reducing the production of contaminants due to oil breakdown.

Numerous modifications and improvements of the invention are apparent to the skilled artisan upon consideration of the foregoing specification. Accordingly, the invention is intended to be limited only by the scope of the following claims.

What is claimed is:

1. A method for prolonging the working life of a lubricant oil in an engine, comprising the sequential steps of:

passing a lubricant oil from an engine through a first composition comprising $SnO_2$, NaOH, and aluminum; and further passing said lubricant oil through a second composition comprising iodine alcohol;

whereby contaminants are removed from said lubricant oil.

2. The method according to claim 1, wherein the weight ratio of $SnO_2$ to NaOH is 1 to 3.

3. The method according to claim 2, wherein said second composition comprises a 5 weight percent solution of iodine in alcohol.

4. The method according to claim 1, wherein said step of passing said lubricant oil from an engine through a first composition includes passing said lubricant oil through a first chamber, and wherein said step of passing said lubricant oil through a second composition includes passing said lubricant oil through a second chamber containing said second composition.

5. The method according to claim 1, wherein said second composition comprises a 5 weight percent solution of iodine in alcohol.

6. The method according to claim 1, wherein said alcohol is ethanol.

7. A method for prolonging the working life of a lubricant oil in an engine, comprising the sequential steps of:

passing a lubricant oil from an engine through a first composition comprising iodine in alcohol; and further passing said lubricant oil through a second composition comprising $SnO_2$, NaOH, and aluminum;

whereby contaminants are removed from lubricant oil.

8. The method according to claim 7, wherein the weight ratio of $SnO_2$ to NaOH is 1 to 3.

9. The method according to claim 8, wherein said second composition comprises a 5 weight percent solution of iodine in alcohol.

10. The method according to claim 7, wherein said step of passing said lubricant oil from an engine through a first composition includes passing said lubricant oil through a first chamber containing said first composition and wherein said step of passing said lubricant oil through a second composition includes passing said lubricant oil through a second chamber containing said second composition.

11. The method according to claim 7, wherein said second composition comprises a 5 weight percent solution of iodine in alcohol.

12. The method according to claim 7, wherein said alcohol is ethanol.

13. An apparatus for prolonging the working life of a lubricant oil in an engine, the apparatus comprising:

a housing;

a first chamber within said housing, said first chamber containing a first composition comprising $SnO_2$, NaOH, and aluminum;

an inlet for introducing lubricant oil from an engine to said first chamber a second chamber within said housing in liquid communication with said first chamber and containing an absorptive material impregnated with a second composition comprising iodine in alcohol; and, an outlet by which lubricant oil exits said housing from said second chamber to the engine

14. The apparatus according to claim 13, wherein said first and second chambers are cylindrical chambers which share a common wall.

15. The apparatus according to claim 14, wherein said common wall comprises a meshwork filter.

16. The apparatus according to claim 13, wherein said second chamber contains aluminum metal distributed in said second chamber.

17. The apparatus according to claim 13, wherein said first and second chambers have top and bottom portions with end caps attached thereto.

18. The apparatus according to claim 13, further comprising a safety valve in liquid communication with said lubricant oil in said apparatus.

19. The apparatus according to claim 13, wherein said outer cylindrical wall, said inner cylindrical wall, and said central cylindrical wall each define apertures through which said lubricant oil flows.

20. The apparatus according to claim 13, wherein the weight ratio of $SnO_2$ to NaOH is 1 to 3.

21. The apparatus according to claim 20, wherein said second composition comprises a 5 weight percent solution of iodine in alcohol.

22. The apparatus according to claim 13, wherein said second composition comprises a 5 weight percent solution of iodine in alcohol.

23. The apparatus according to claim 13, wherein said alcohol is ethanol.

* * * * *